US007469039B2

(12) United States Patent
Hamann et al.

(10) Patent No.: US 7,469,039 B2
(45) Date of Patent: Dec. 23, 2008

(54) DEVICE AND METHOD FOR GENERATING AN X-RAY POINT SOURCE BY GEOMETRIC CONFINEMENT

(75) Inventors: Hendrik F. Hamann, Mohegan Lake, NY (US); Yves Martin, Ossining, NY (US); Theodore G. van Kessel, Millbrook, NY (US); Hemantha K. Wickramasinghe, San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 4 days.

(21) Appl. No.: 11/497,252

(22) Filed: Aug. 2, 2006

(65) Prior Publication Data

US 2006/0269047 A1 Nov. 30, 2006

Related U.S. Application Data

(63) Continuation of application No. 10/445,856, filed on May 28, 2003, now Pat. No. 7,130,379.

(51) Int. Cl.
*H01J 35/00* (2006.01)

(52) U.S. Cl. ..... 378/119; 378/43

(58) Field of Classification Search ..... 378/43, 378/62, 119, 122, 129, 143, 136; 250/370.08, 250/370.09

See application file for complete search history.

(56) References Cited

U.S. PATENT DOCUMENTS

| | | | | |
|---|---|---|---|---|
| 6,108,402 | A * | 8/2000 | Chornenky | 378/119 |
| 6,248,990 | B1 * | 6/2001 | Pyyhtia et al. | 250/208.1 |
| 6,377,660 | B1 * | 4/2002 | Ukita et al. | 378/143 |
| 2003/0108155 | A1 * | 6/2003 | Wilkins et al. | 378/119 |

* cited by examiner

*Primary Examiner*—Courtney Thomas
(74) *Attorney, Agent, or Firm*—Stephen C. Kaufman, Esq.; McGinn IP Law Group, PLLC

(57) ABSTRACT

A device for generating an x-ray point source includes a target, and an electron source for producing electrons which intersect with the target to generate an x-ray point source having a size which is confined by a dimension of the target.

2 Claims, 6 Drawing Sheets

DEVICE AND METHOD FOR GENERATING AN X-RAY POINT SOURCE BY GEOMETRIC CONFINEMENT

This Application is a Continuation Application of U.S. patent application Ser. No. 10/445,856 which was filed on May 28, 2003 now U.S. Pat. No. 7,130,379.

BACKGROUND OF THE INVENTION

1. Field of the Invention

The present invention generally relates to a device and method for generating an x-ray point source and, in particular, a device a method for generating an x-ray point source by geometric confinement.

2. Description of the Related Art

Conventional imaging methods commonly produce an x-ray image of an object by examining the attenuation that the object causes when placed between an x-ray source and a detector. Photographic film images produced by this method in the medical field are widely familiar.

However, images so obtained are limited in resolution by physical size of the x-ray source. Therefore, although in theory x-ray images can be produced down to angstrom resolution, in practice this is not possible because of the typically large dimensions of the x-ray source.

In addition, in order to obtain x-ray beams with resolution on the order of 300 angstroms, synchrontron and x-ray optics equipment costing millions of dollars is required. Therefore, high resolution imaging is currently very expensive.

SUMMARY OF THE INVENTION

In view of the above-referenced problems and disadvantages associated with conventional devices and methods, it is a purpose of the present invention to provide an effective inexpensive device and method for producing a point x-ray source (e.g., tens of angstroms) (e.g., a bright point x-ray source), and an x-ray imaging (or microscope) apparatus which is inexpensive and may be used to produce high resolution x-ray images.

The present invention includes an inventive device for generating an x-ray point source which includes a target (e.g., a solid tip, a membrane, or a lump of material), and an electron source for producing electrons which intersect with the target to generate an x-ray point source having a size which is confined by a dimension of the target. For example, the dimension may include a lateral dimension which is about 100 Angstroms or less. The target may also include a conductor which is electrically biased for attracting electrons.

For example, a membrane may be formed in a tip of the target. In this case, the target may further include an insulating layer and a metal cladding formed on the insulating layer. In addition, the membrane may include a membrane tip which is fonned on an end portion of the target, the electrons being incident to the membrane tip from a direction inside the target. Further, a vacuum may be pulled on the inside of the target.

The device may also include a material formed on (e.g., coated on) the target for producing a desired characteristic (e.g., a fluorescent characteristic) of the x-rays. For example, the coating may include one of gold and germanium.

Further, the electron source may include an electron beam generator (e.g., a scanning electron microscope). In addition, the electron source may include a filament, and may generate electrons which are incident to the target from a plurality of directions.

The device may also include a carrier medium which supports the target (e.g., a lump target). For example, the target may be disposed on a surface of the carrier medium, or beneath a surface of the carrier medium. Further, the target may include a spherical target such as a gold Sphere.

In addition, the carrier medium may include a transparent membrane which includes a material having a low atomic number. Further, the carrier medium may include one of carbon and a nitride.

The present invention also includes an inventive x-ray imaging apparatus. The inventive apparatus includes a device for generating an x-ray point source (e.g., a target, and an electron source for producing electrons which intersect with the target to generate an x-ray point source having a size which is confined by a dimension of the target). The x-rays are emitted in the direction of a specimen to be imaged. The apparatus also includes at least one image pickup device (e.g., a plurality of image pickup devices) which receives the x-rays so as to pick up an image (e.g., a tomographic image) of the specimen.

For example, the image pickup device may include a charge coupled device. The apparatus may also include a silicon nitride membrane, the specimen being disposed adjacent to the silicon nitride membrane.

Further, the x-ray imaging apparatus may include an x-ray microscope apparatus. The apparatus may also include a computer which processes a signal from the at least one image pickup device. The apparatus may also include a display device which uses a processed image signal from the computer to reproduce the image.

The present invention also includes an inventive method for generating an x-ray point source. The inventive method includes providing a target, and intersecting electrons with the target to generate an x-ray point source having a size which is confined by a dimension of the target.

With its unique and novel features, the present invention provides an effective inexpensive device and method for producing a point x-ray source (e.g., tens of angstroms) (e.g., a bright point x-ray source), and an x-ray imaging apparatus which are inexpensive and may be used to produce high resolution x-ray images.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1A:
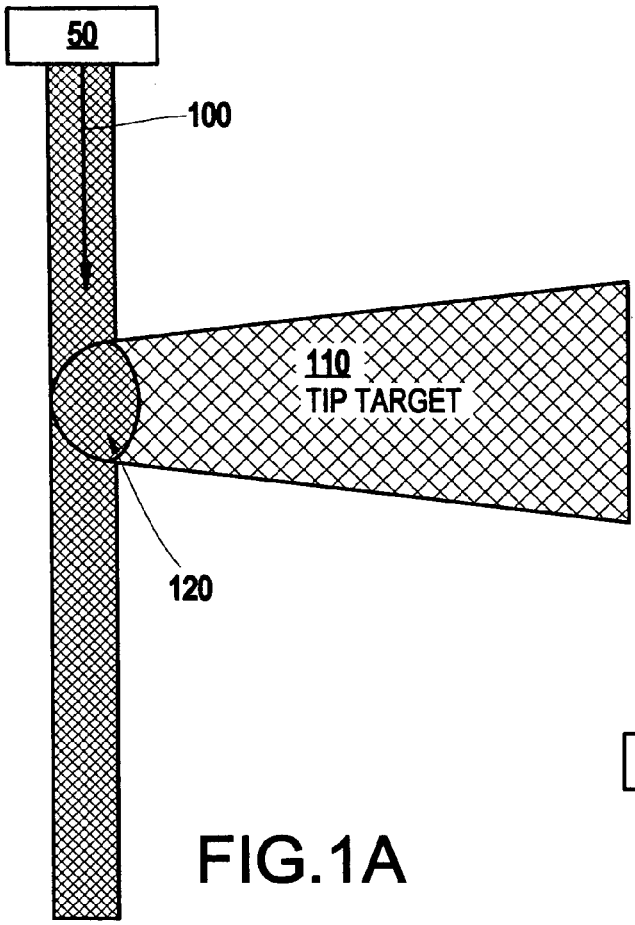
FIGS. 1A-1B illustrate the principles of geometrically-confined x-ray emission according to the present invention.
Figure 1B:
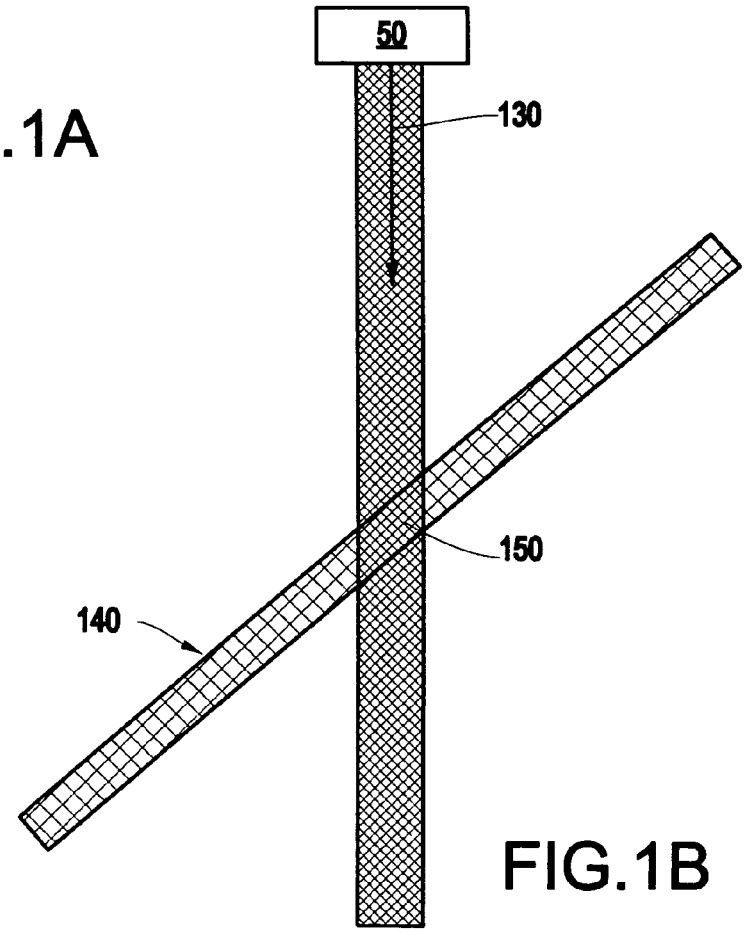

Referring now to the drawings, and more particularly to FIGS. 1A-1B, the present invention is directed, in part, to a device and method for generating an x-ray point source (e.g., a very small point source of x-rays).

As noted above, although in theory x-ray images can be produced down to angstrom resolution, this is not possible in practice because of the typically large dimensions of the x-ray source and coherence effects. The present invention, however, generates an x-ray point source by intersecting (e.g., impinging) high energy electrons on a target such as a solid tip or small lump of material in order to geometrically confine the source of the x-rays by a dimension (e.g., a lateral dimension as viewed from an image plane) of the target tip or lump. As a result, the present invention is able to produce x-ray images down to an angstrom resolution (e.g., about 150 angstroms or less).

Generally, electrons produce x-rays when they collide with atoms at energies in excess of a few hundred electron volts. In addition, the higher the atomic number (Z) of the atom, the more readily the atom produces x-rays when collided with electrons. Thus, heavy materials (e.g., dense materials) will attenuate electrons and produce x-rays more readily than light materials such as carbon since the heavy materials have a significantly higher interaction cross-section than the light materials. A vacuum, of course, produces no x-rays since there is no mass into which the electron may collide.

Further, the energy spectrum of x-rays produced will be skewed according to the target material atomic number. If a particular energy of x-rays is desired, the target material fluorescence can be advantageously used to enhance x-rays production at a particular energy level.

In the present invention, the x-ray point source may be confined due to a geometric intersection of electrons (e.g., an electron beam) with a target. Specifically, the target may be microscopic and largely transparent to electrons. Thus, a single collision between the electron and the target may be likely.

More specifically, in the present invention, electrons may be collided with extremely small (e.g., tens of angstroms) tips or lumps of target material. For example, a metal tip can be biased electrically to attract electrons produced from a photocathode or heated filament source in vacuum. If sufficient accelerating voltage is provided, the electrons incident on the tip will cause x-rays (e.g., a quantity of x-rays, or number of photons) to be generated which is proportional to the accelerating voltage and the size and material composition of the tip (e.g., geometrically-confined region).

Further, this approach can be turned "inside out" by propagating electrons down a narrow tube with an electrically biased metal end cap. In this case, for example, a vacuum may be pulled on the inside of the tube, and the end of the tube may include a membrane tip.

In all cases, the size (e.g., the apparent size) of the point source may be determined by the geometric intersection of the electron beam with the geometric dimension of the target (e.g., the tip or lump) as viewed from the image plane. This dimension can be on the order of tens of angstroms (e.g., about 100 angstroms or less). Thus, in the present invention, the number of x-ray photons generated by even nanoamperes of current can be large and thus result in a very bright source.

The preferred means of achieving the same result is to place the tip or lump in the chamber of the scanning electron microscope (SEM) and use the electron beam to excite x-ray generation in the target material. This provides a very controlled source of electrons in terms of current and electron energy. Care should be taken to maintain the electron current low enough to prevent melting of the tip or lump material.

Referring again to the drawings, FIGS. 1A-1B illustrate the principles of geometrically-confined x-ray emission according to one example the present invention. Specifically, as shown in FIG. 1A, an electron source 50 may generate electrons 100 (e.g., an electron beam) which are incident to (e.g., intersect or collide with) a tip target 110. In this case, only region 120 (e.g., a geometrically-confined region) of the tip target 110 may be used to generate an x-ray point source. Therefore, it is said that the x-rays are geometrically confined to the region 120. That is, for the purposes of the present Application, the term "geometrically-confined" may be understood to mean that a size of the x-ray point source (e.g., the surface area of the target region from which x-rays are emitted) may be confined by the geometry of the target.

Similarly, FIG. 1B shows an electron source 50 which generates electrons 130 (e.g., an an electron beam) which are incident to (e.g., intersect or collide with) a membrane target 140. In this case, only region 150 (e.g., geometrically confined region) of the membrane target 140 may be used to generate an x-ray point source. Therefore, it may be said that the x-rays are geometrically confined to the region 150. It should also be noted that a material may be formed on the membrane target 140 (as well as the tip region in FIG. 1A) to control the characteristics of the x-rays generated. For example, a material may be coated on the target to provide desirable characteristics.

Figure 2A:
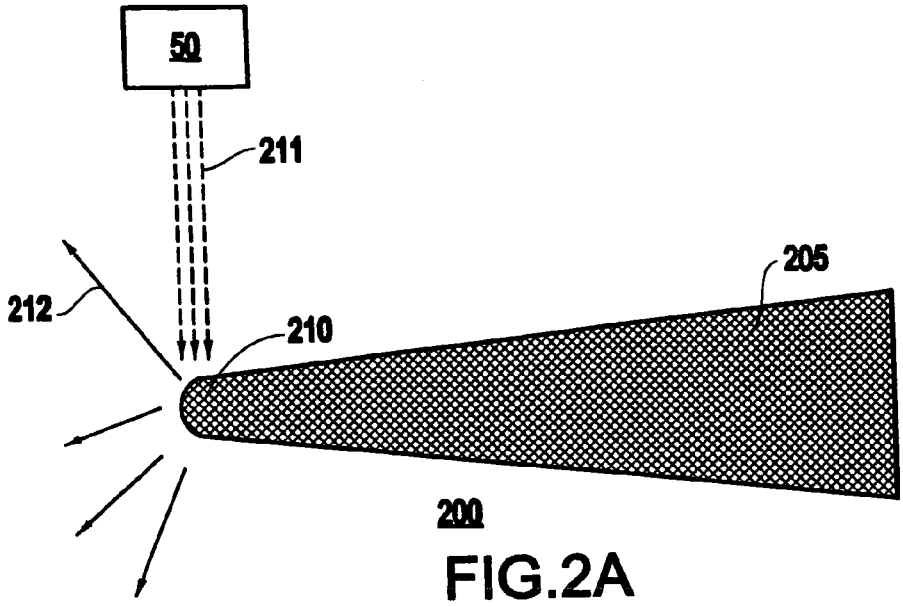
FIGS. 2A-2B illustrate two possible configurations for the inventive device 200 for generating an x-ray point source using a tip target (e.g., a solid tip target)
Figure 2B:
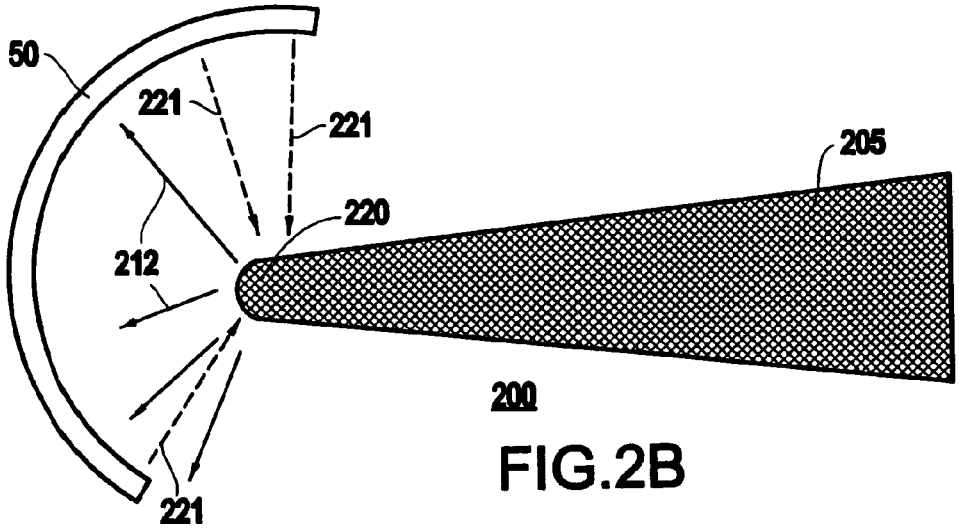
Figure 2C:
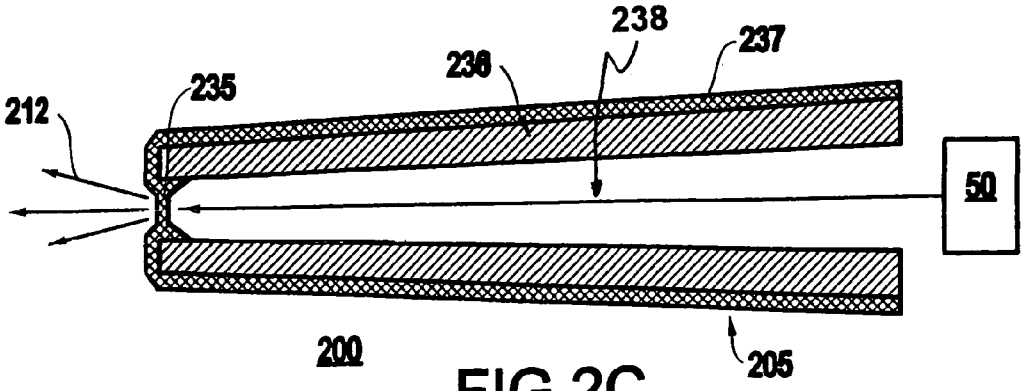
FIGS. 2C illustrates a possible configuration for the inventive device 200 for generating an x-ray point source using a membrane target (e.g., a membrane tip target)

FIGS. 2A-2C illustrate three possible configurations for the inventive device 200 using a target 205. Specifically, FIGS. 2A-2B illustrate two examples of the device 200 using a tip (e.g., a solid tip from which x-rays may be emitted at an angle from an indicent direction of the electrons), and FIG. 2C illustrates an example of a device 200 using a membrane in the tip of the target (e.g., a tip from which x-rays may be emitted substantially along a line with an incident direction of the electrons), according to the present invention.

The devices 200 illustrated in FIGS. 2A-2C may include micro-fabricated tips with lateral dimensions on the order of about 100 angstroms. In each case, the tip may be electrically biased to accelerate the electrons in a direction incident to the tip. In addition, electrons may be directly impinged on the tip (e.g., from one direction or from a plurality of directions).

For example, as illustrated in FIG. 2A, an electron source 50 generates electrons 211 in the form of an electron beam which is is directly impinged on the tip 210. In this case, x-rays 212 (e.g., isotropically emitted x-rays) are emitted from the region of the tip 210 (e.g., a geometrically confined region of the target 205). In FIG. 2B, on the other hand, the electron source 50 generates electrons 221 which are incident to the tip 220 (e.g., intersect with the tip) from a plurality of directions.

It should again be noted that in any case, electrons may be accelerated to a region of the tip 220 by an electric field applied to the target (e.g., tip 220). Specifically, in such case, the conducting tip 220 may be electrically biased to attract electrons from the electron source 50 (e.g., a scanning electron microscope (SEM)).

In FIG. 2C, the target 205 includes a membrane tip 235. As with tip targets 205 (e.g., solid tip targets) in FIGS. 2A, 2B, the material of the membane tip 235 may be varied depending upon the type of x-rays desired. For example, the membrane tip 235 may include a Au or SiN membrane and may be "sandwiched" between an insulator 236 having a metal cladding 237 formed thereon. Specifically, the membrane may be formed at an end portion (e.g., the tip) of the insulator and metal cladding. The metal cladding 237 may be electrically biased to attract electrons from the source to the tip. Further, as shown in FIG. 2C, the electron flow 238 may be between the insulator 236 and incident to the membrane tip 235 from a direction inside the target.

One utility of the membrane tip, is that it allows operation in air. For example, a vacuum (e.g., a partial vacuum) may be pulled inside the tip-source volume while outside the tip air or other gases may be present.

In one exemplary embodiment, the insulator 236 and metal cladding 237 may have a cylindrical (e.g., tube) shape. In this case, the membrane tip 235 may be formed at an end portion of the cylinder or tube (e.g., as shown in FIG. 2C).

For example, the inventors have developed a prototype in which an aluminum foil membrane tip having a thickness of about 2 μm was formed at the end of a tube (e.g., see FIG. 2C). In this prototype, the electrons are propagated down the capillary tube with an internal dimension of about 100 μm.

Further, a lump of material may be formed (e.g., deposited) on a tip (e.g., tip 210, 220) or on the membrane 235 to control the characteristics of the x-rays generated. For example, a Ge coating (e.g., a conformal coating) which is about 50 Å wide may be formed on the tip 210, 220 or on the membrane 235.

Figure 3A:
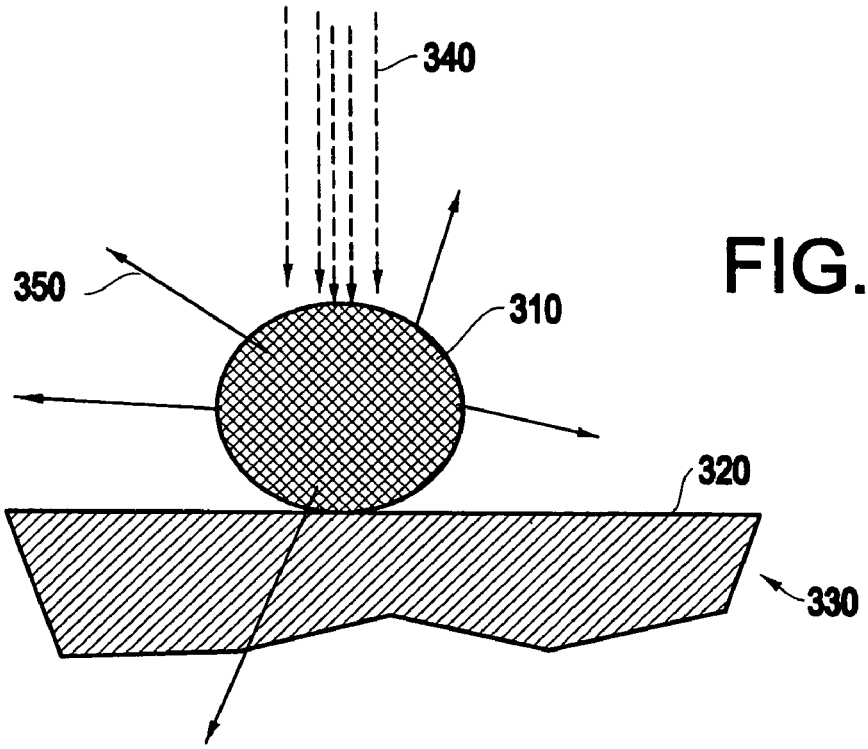
FIGS. 3A-3B illustrate two exemplary embodiments of the inventive device 200 which include a "lump" target for producing x-rays.
Figure 3B:
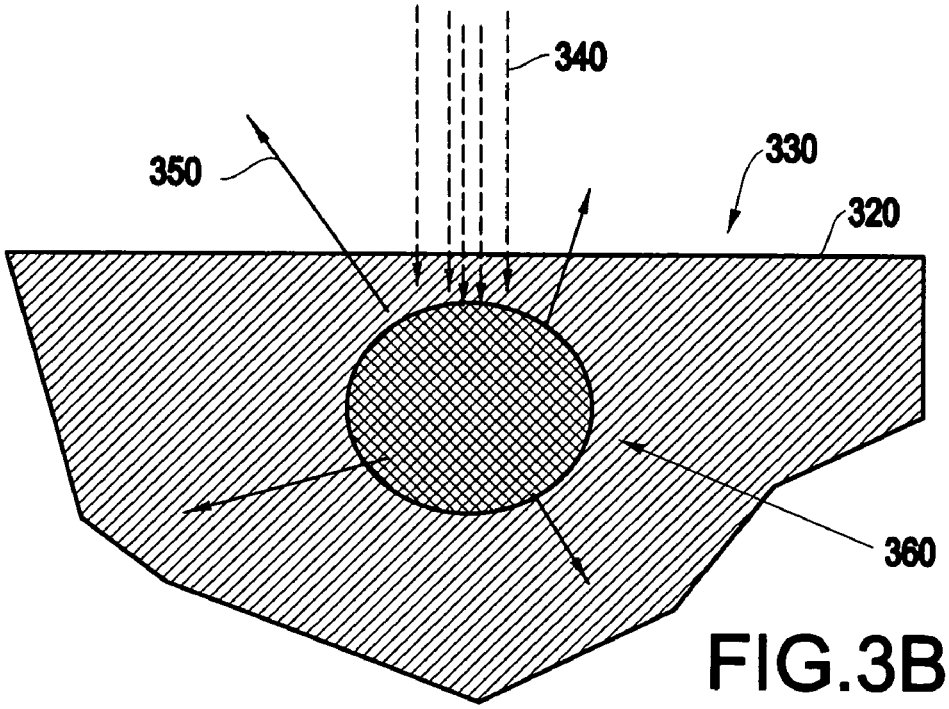

Referring again to the drawings, FIGS. 3A-3B illustrate two exemplary embodiments of the inventive device 200 which include a "lump" target for producing x-rays. For example, the "lump" may include a sphere (e.g., micro-fabricated sphere) with a lateral dimension on the order of about 50 angstroms placed on or inside (e.g., under the surface of) a carrier material. Specifically, the target may be formed as a lump on or in a transparent or low Z membrane (e.g., a membrane including a material having a low atomic number).

Specifically, as shown in FIG. 3A, the target 310 (e.g., lump material) is formed on a surface 320 of the carrier medium material 330. The impinging electron beam 340 may be used as a source of high energy electrons which collide with the target 310 causing x-rays 350 to be emitted (e.g., generating an x-ray point source having a size which is confined by a dimension of the lump target 310).

Alternatively, as shown in FIG. 3B, the target 360 (e.g., lump material) may be formed under the surface 320 of the carrier medium material 330. The impinging electron beam 340 may be used as a source of high energy electrons which collide with the target 3160 in the carrier medium material 330 causing x-rays 350 to be emitted (e.g., generating an x-ray point source having a size which is confined by a dimension of the lump target 360).

By choosing a carrier medium material 330 with a significantly lower interaction cross-section, the geometric source boundaries are retained since most of the x-ray photons produced with come from the lump material. For example, a gold sphere target on or in a carbon or nitride carrier would provide good results, although other materials may certainly be used.

One advantage of this embodiment is that targets (e.g., tip targets) may be fabricated to dimensions of 100 angstroms or less. However, gold spheres can be purchased readily with diameters of about 50 angstroms. Thus, in the present invention, an extremely small point source of x-rays can be realized at very low cost. For example, an assembly consisting of a vacuum vessel, vacuum pump, tip, filament and power supply can be constructed for a few thousand dollars.

The present invention also includes an inventive x-ray imaging apparatus. Specifically, the inventive apparatus includes a device for generating an x-ray point source (e.g., a target, and an electron source for producing electrons which intersect with the target to generate an x-ray point source having a size which is confined by a dimension of the target, such that x-rays are emitted in a direction of a specimen), and at least one image pickup device (e.g., a plurality of image pickup devices) which receives the x-rays so as to pick up an image of the specimen.

Figure 4:
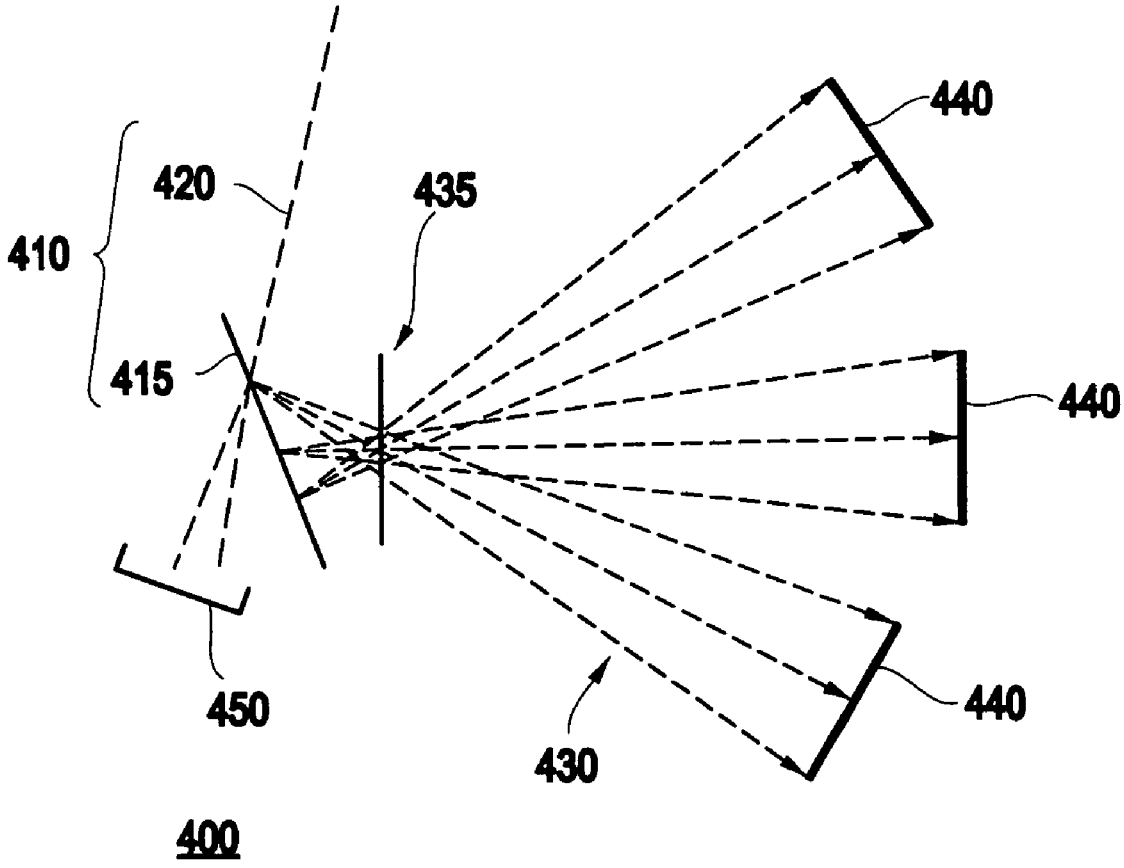
FIG. 4 illustrates an inventive x-ray imaging apparatus 400 (e.g., a nanosource x-ray imaging apparatus) according to the present invention.

FIG. 4 illustrates an exemplary embodiment of an x-ray imaging apparatus 400 (e.g., a nanosource x-ray imaging apparatus) according to the present invention. The apparatus 400 includes a device 410 for generating an x-ray point source (e.g., a membrane target 415 (e.g., gold on nitride) and electron beam 420 (e.g., a focused electron beam)) which emits x-rays 430 from a region of the target 415. For example, the membrane target may be a nitride membrane which having a gold coating.

As shown in FIG. 4, the x-rays 430 are emitted in the direction of a specimen (e.g., sample) 435 to be imaged. The inventive apparatus 400 further includes a plurality of image pickup devices 440 (e.g., charge coupled devices) which receive x-rays 430 so as to pick up an image (e.g., a tomographic image) of the specimen 435. The inventive imaging apparatus 400 may also include a beam dump 450 for collecting a portion of the electron beam 420 which is not used in producing an image of the specimen 435.

It should be noted that although only a membrane target is illustrated in FIG. 4, a tip target (e.g., as illustrated in FIGS. 2A-2B) could also be used.

Figure 5A:
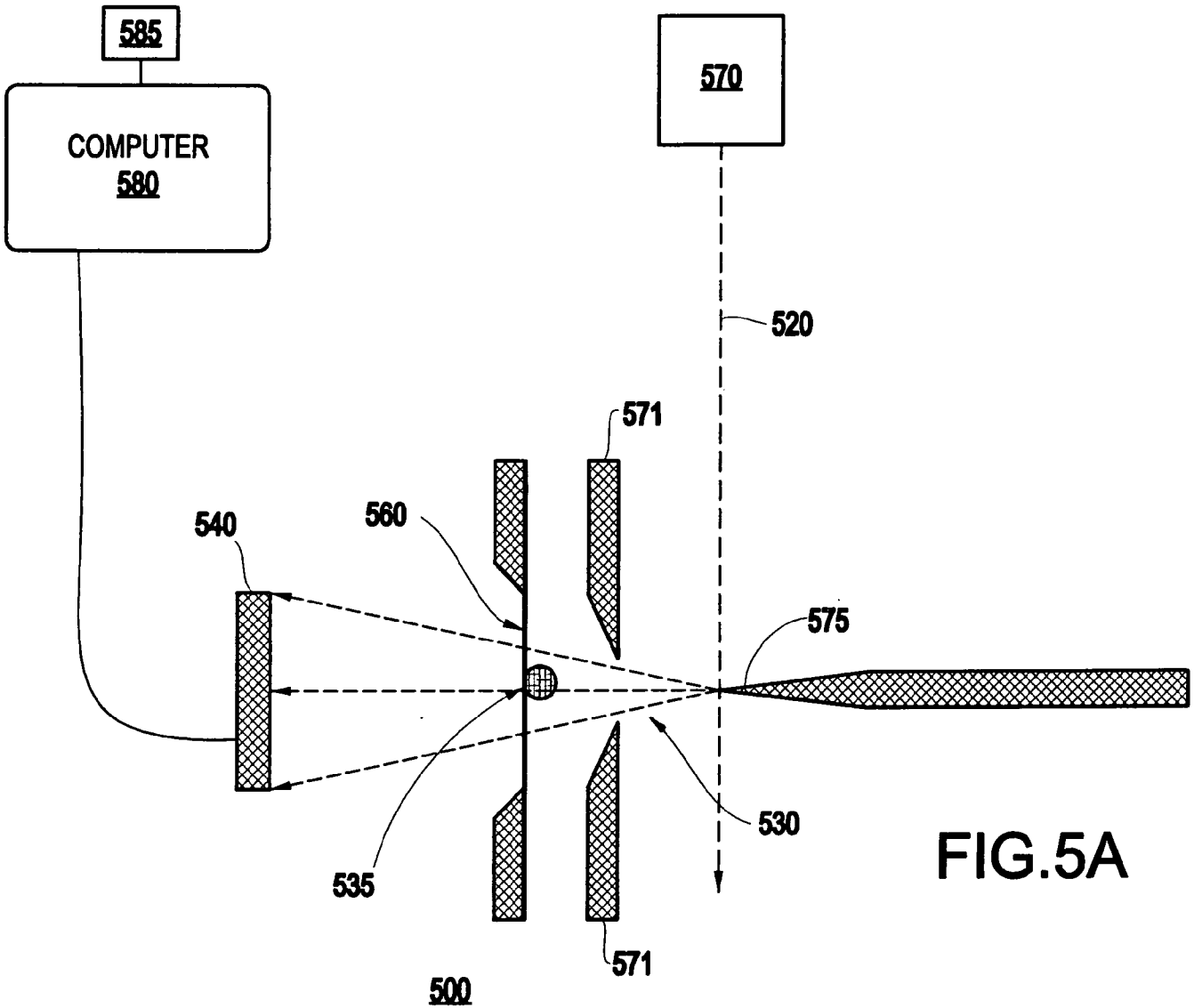
FIGS. 5A-5B illustrate an x-ray microscope apparatus 500, 550 according to the present invention.
Figure 5B:
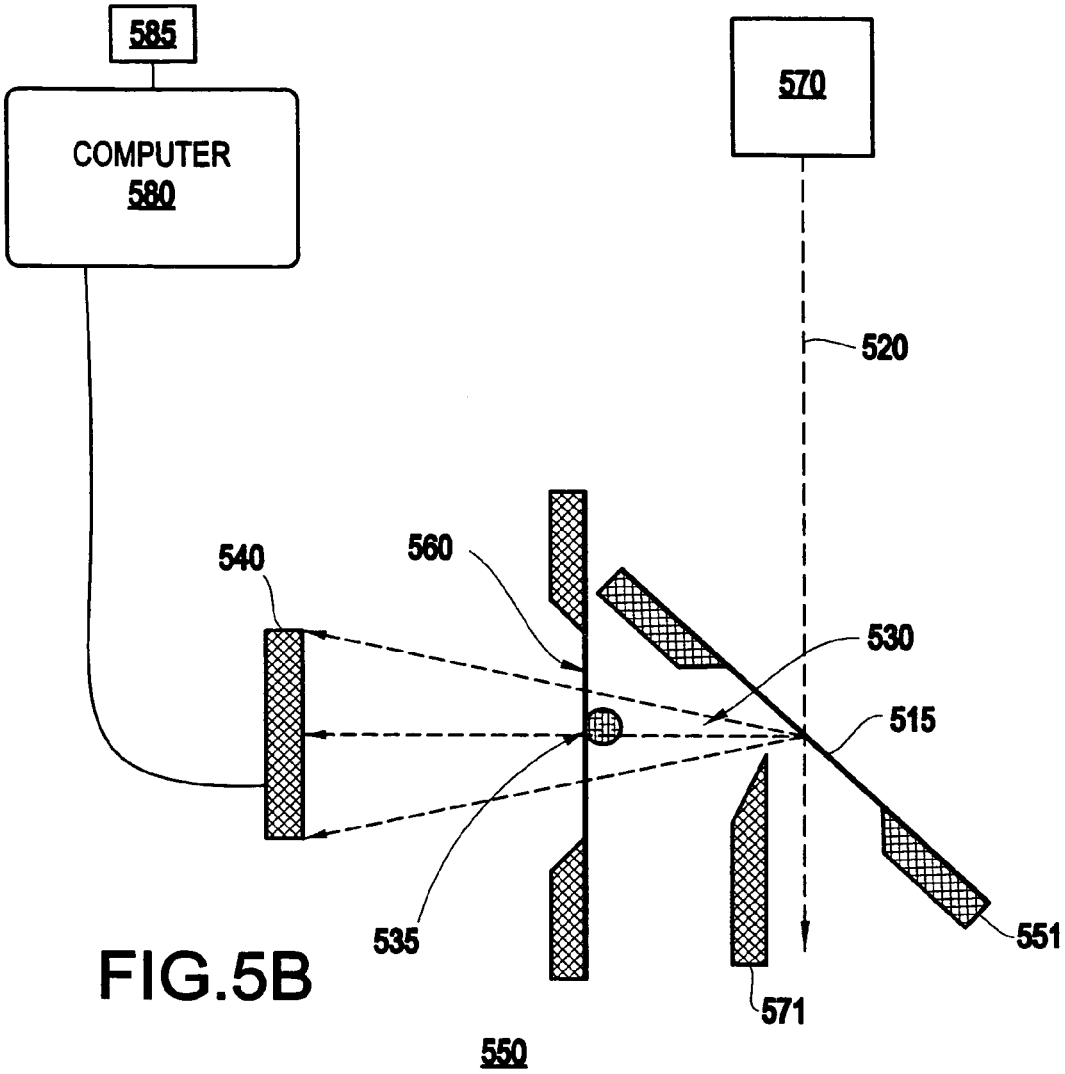

FIGS. 5A-5B illustrate another aspect an x-ray imaging apparatus according to the present invention. Specifically, FIGS. 5A-5B illustrate an x-rax microscope apparatus 500, 550 according to the present invention.

The inventive microscope apparatus 500 includes a device for generating an x-ray point source 510 (e.g., a target 515 (optionally coated) such as a tip or a membrane, and an electron beam 520 (e.g., a focused electron beam)) which emits x-rays 530 from the target 515 in the direction of a specimen 535 to be imaged.

Specifically, FIG. 5A illustrates a microscope apparatus 500 in which the target 515 is a tip target. In addition, FIG. 5B illustrates a microscope apparatus 550 in which the target 515 is a membrane target (e.g., silicon nitride membrane target). In this case a structure 551 may be used to support the membrane.

The inventive microscope apparatus 500, 550 further includes at least one image pickup device 540 (e.g., charge coupled device) which receives the x-rays 530 so as to pick up an image of the specimen 535.

As noted above, the microscope apparatus 500, 550 may utilize a membrane 560 (e.g., silicon nitride membrane). In this case, the specimen 535 may being disposed adjacent to the silicon nitride membrane 560.

Further, the apparatus 500, 550 may also include an electron beam generator 570 (e.g., scanning electron microscope) for generating the electron beam 520, and at least one baffle 571 for controlling the x-rays 530 generated by the device for generating an x-ray point source 510.

The apparatus 500, 550 may also include a computer 580 (e.g., a computer with a frame grabber) which processes a signal from the image pickup device 540. Further, the apparatus 500, 550 may include a display device 585 which uses a processed image signal from the computer 580 to reproduce the image of the specimen.

Figure 6:
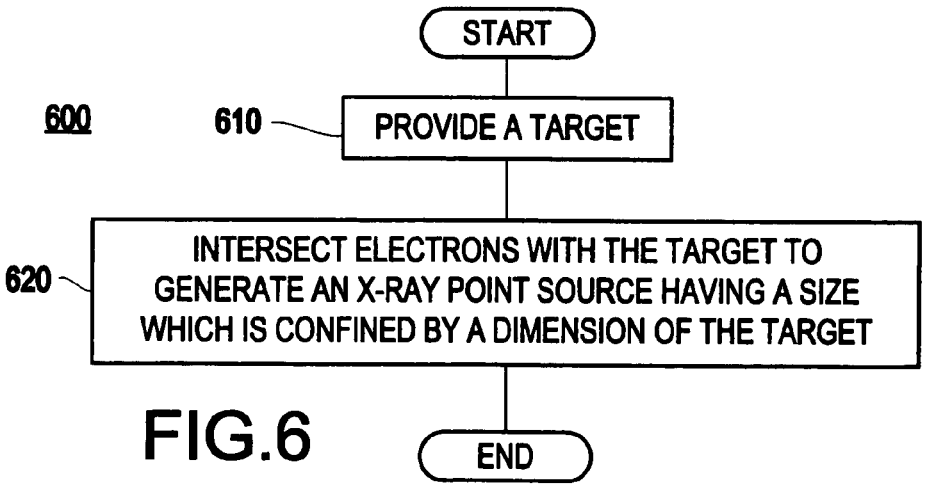
FIG. 6 illustrates an inventive method 600 of generating an x-ray point source according to the present invention.

FIG. 6 illustrates an inventive method 600 of generating an x-ray point source according to the present invention. The inventive method 600 includes providing (610) a target, and intersecting (620) electrons with the target to generate an x-ray point source having a size which is confined by a dimension of the target. For example, the inventive method 600 may utilize the features of the inventive device for generating an x-ray point source as described above.

With its unique and novel features, the present invention provides an effective inexpensive device and method for producing a point x-ray source (e.g., tens of angstroms) (e.g., a bright point x-ray source), and an x-ray imaging apparatus which are inexpensive and may be used to produce high resolution x-ray images.

While the invention has been described in terms of preferred embodiments, those skilled in the art will recognize that the invention can be practiced with modification within the spirit and scope of the appended claims.

Further, Applicant's intent is to encompass the equivalents of all claim elements, and no amendment to any claim the present application should be construed as a disclaimer of any interest in or right to an equivalent of any element or feature of the amended claim.

What is claimed is:

1. A method for generating an x-ray point source comprising:

providing a target; and intersecting an electron beam with said target to generate a point source of x-rays, said point source having a size which is confined by a physical dimension of said target and a physical dimension of said electron beam.

2. The method of claim 1, wherein said electron beam is one of collimated and focused.

* * * * *